US006334735B1

(12) United States Patent
Williams et al.

(10) Patent No.: US 6,334,735 B1
(45) Date of Patent: Jan. 1, 2002

(54) CONTROLLER FOR A PAVING SCREED HEATING SYSTEM

(75) Inventors: Timothy D. Williams, Charleston; Michael J. Worley, Mattoon, both of IL (US); Brian V. Thompson, Headington (GB)

(73) Assignee: Blaw Knox Construction Equipment Corporation, Mattoon, IL (US)

( * ) Notice: Subject to any disclaimer, the term of this patent is extended or adjusted under 35 U.S.C. 154(b) by 0 days.

(21) Appl. No.: 09/502,964

(22) Filed: Feb. 11, 2000

Related U.S. Application Data

(60) Provisional application No. 60/119,708, filed on Feb. 11, 1999.

(51) Int. Cl.[7] ..... E01C 23/07; E01C 23/14

(52) U.S. Cl. ..... 404/79; 404/84.05; 404/95; 700/19; 700/300

(58) Field of Search ..... 404/75, 79, 84.05, 404/95, 118; 700/2, 19, 20, 207, 299, 300

(56) References Cited

U.S. PATENT DOCUMENTS

| | | | | |
|---|---|---|---|---|
| 3,557,672 A | | 1/1971 | Shurtz et al. | |
| 4,319,856 A | * | 3/1982 | Jeppson | 404/79 |
| 4,409,662 A | * | 10/1983 | Rao | 700/300 |
| 4,429,216 A | | 1/1984 | Brigham | |
| 4,561,800 A | * | 12/1985 | Hatakenaka et al. | 404/79 |
| 4,656,339 A | | 4/1987 | Grise | |
| 4,661,689 A | | 4/1987 | Harrison | |
| 4,717,812 A | | 1/1988 | Makita | |
| 4,725,717 A | | 2/1988 | Harrison | |
| 4,752,155 A | | 6/1988 | Rennich | |
| 4,942,078 A | | 7/1990 | Newman et al. | |
| 5,004,895 A | | 4/1991 | Nishino et al. | |
| 5,096,331 A | | 3/1992 | Raymond | |
| 5,259,693 A | * | 11/1993 | Raymond | 404/95 |
| 5,308,190 A | | 5/1994 | Raymond | |
| 5,417,516 A | | 5/1995 | Birtchet | |
| 5,521,850 A | * | 5/1996 | Moe et al. | 700/299 |
| 5,599,133 A | * | 2/1997 | Costello et al. | 404/72 |
| 5,607,254 A | * | 3/1997 | Grembowicz et al. | 404/79 |
| 5,653,552 A | | 8/1997 | Wiley et al. | |
| 5,747,777 A | * | 5/1998 | Matsuoka | 219/497 |
| 5,895,172 A | | 4/1999 | Grembowicz et al. | |
| 5,899,630 A | * | 5/1999 | Brock | 404/79 |

* cited by examiner

*Primary Examiner*—Gary S. Hartmann
(74) *Attorney, Agent, or Firm*—Michael Best & Friedrich LLP

(57) ABSTRACT

A controller is for a heating system of a paving screed including a screed plate. The heating system is connected with the screed and configured to transfer thermal energy to the screed plate and includes an actuator configured to adjust thermal energy output of the heating system. The controller includes a temperature sensor connectable with the screed and configured to sense temperature of the screed plate. The sensor is also configured to generate electrical signals proportional to sensed temperature. An electrical logic circuit is electrically connected with the sensor and is electrically connectable with the actuator. The logic circuit is configured to compare a temperature signal from the sensor with a desired temperature value and to automatically operate the actuator such that the actuator adjusts thermal energy output of the heating system so as to maintain screed temperature about the desired temperature value. The logic circuit is a microprocessor and the temperature sensor is preferably a thermocouple. The microprocessor has a stored software program that selectively configures the heating system for use with various types of screed heaters.

6 Claims, 2 Drawing Sheets

CONTROLLER FOR A PAVING SCREED HEATING SYSTEM

This application claims the benefit of U.S. Provisional Application No. 60/119,708, filed Feb. 11, 1999.

BACKGROUND OF THE INVENTION

The present invention relates to paving screeds, and more particularly to controllers used with systems for heating paving screeds.

The quality of an asphalt mat is affected by the temperature of the asphalt material during the paving process. One method for ensuring that the asphalt is at a sufficiently high temperature is to use a heated screed, such that thermal energy (i.e., heat) is transferred from the screed to the asphalt while the material is being leveled by the screed. Systems for heating a paving screed include one or more heaters located inside the housing of the screed and configured to transfer thermal energy to the screed plate (the portion of the screed that actually levels the asphalt). Such heating systems include gas burners, usually for diesel or propane gas, in combination with "blower" fans, electrical resistance heaters, etc.

In general, the control of such screed heating systems is merely a simple "on-off" switch that requires the screed operator to start the heating system and then the system operates until such time as the operator decides to shut the system off. If the operator does not properly monitor the temperature of the screed, excessive heating of the screed, causing poor asphalt mat finish or damage to the screed components. Further, if the screed operator shuts down the heating system and then forgets to re-start system, the quality of the asphalt mat is diminished due to leveling with a "cold" screed.

Therefore, it would be desirable to have a controller for a paving screed heating system that operates safely and ensures that the heating system does not over-heat or insufficiently heat the screed.

SUMMARY OF THE INVENTION

The present invention is controller for a heating system of a paving screed including a screed plate. The heating system is connected with the screed and is configured to transfer thermal energy to the screed plate. The heating system 1 further includes an actuator 16 configured to adjust thermal energy output of the heating system. The controller comprises a temperature sensor connectable with the screed and configured to sense temperature of the screed plate. The sensor is also configured to generate electrical signals proportional to sensed temperature. Further, an electrical logic circuit is electrically connected with the sensor and electrically connectable with the actuator. The logic circuit is configured to compare a temperature signal from the sensor with a desired temperature value and to automatically operate the actuator such that the actuator adjusts thermal energy output of the heating system so as to maintain the screed temperature about the desired temperature value.

BRIEF DESCRIPTION OF THE SEVERAL VIEWS OF THE DRAWINGS

The description of the invention below will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DESCRIPTION OF THE INVENTION

Figure 1:
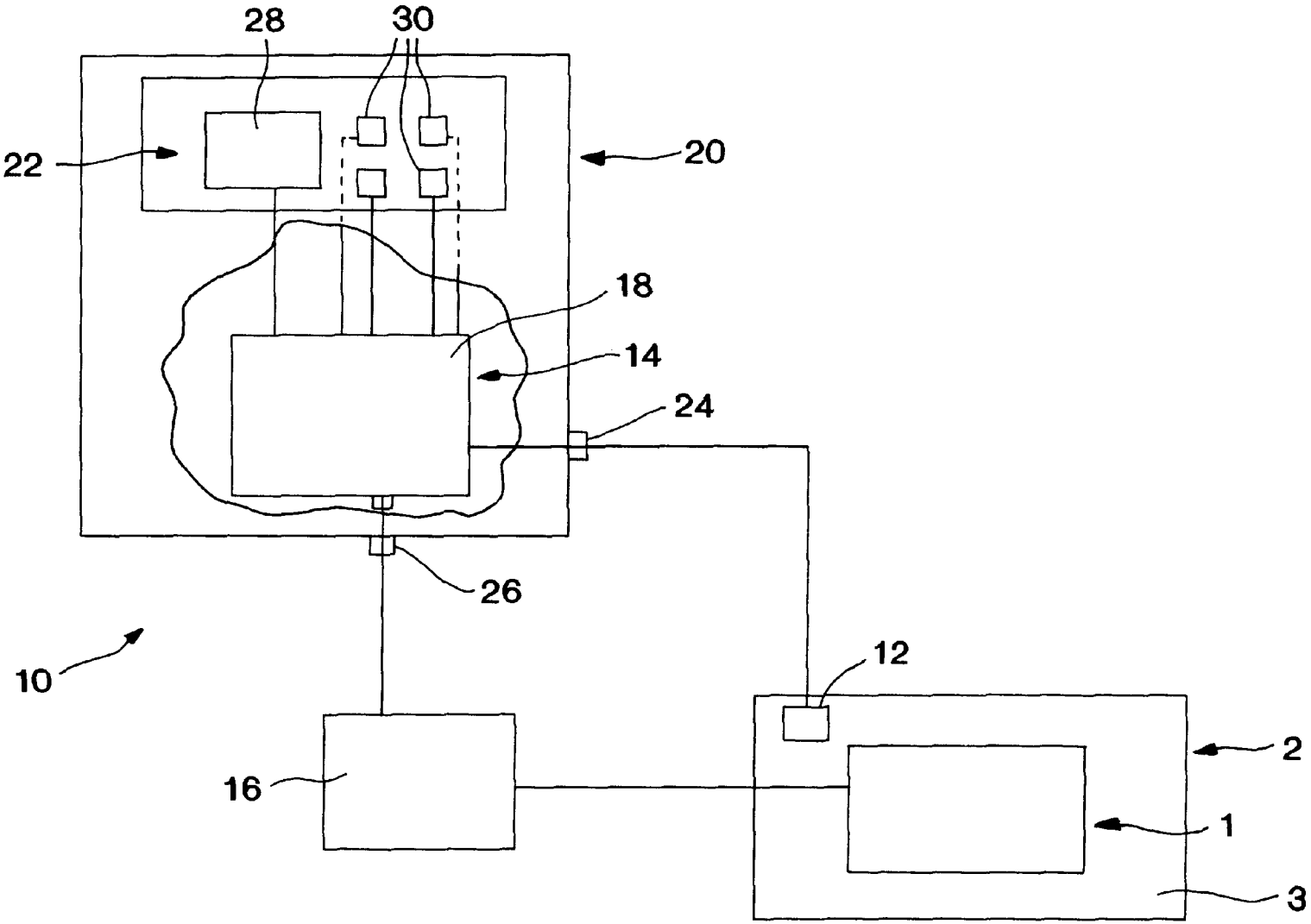
FIG. 1 is a schematic diagram of the control system in accordance with the present invention.
Figure 2:
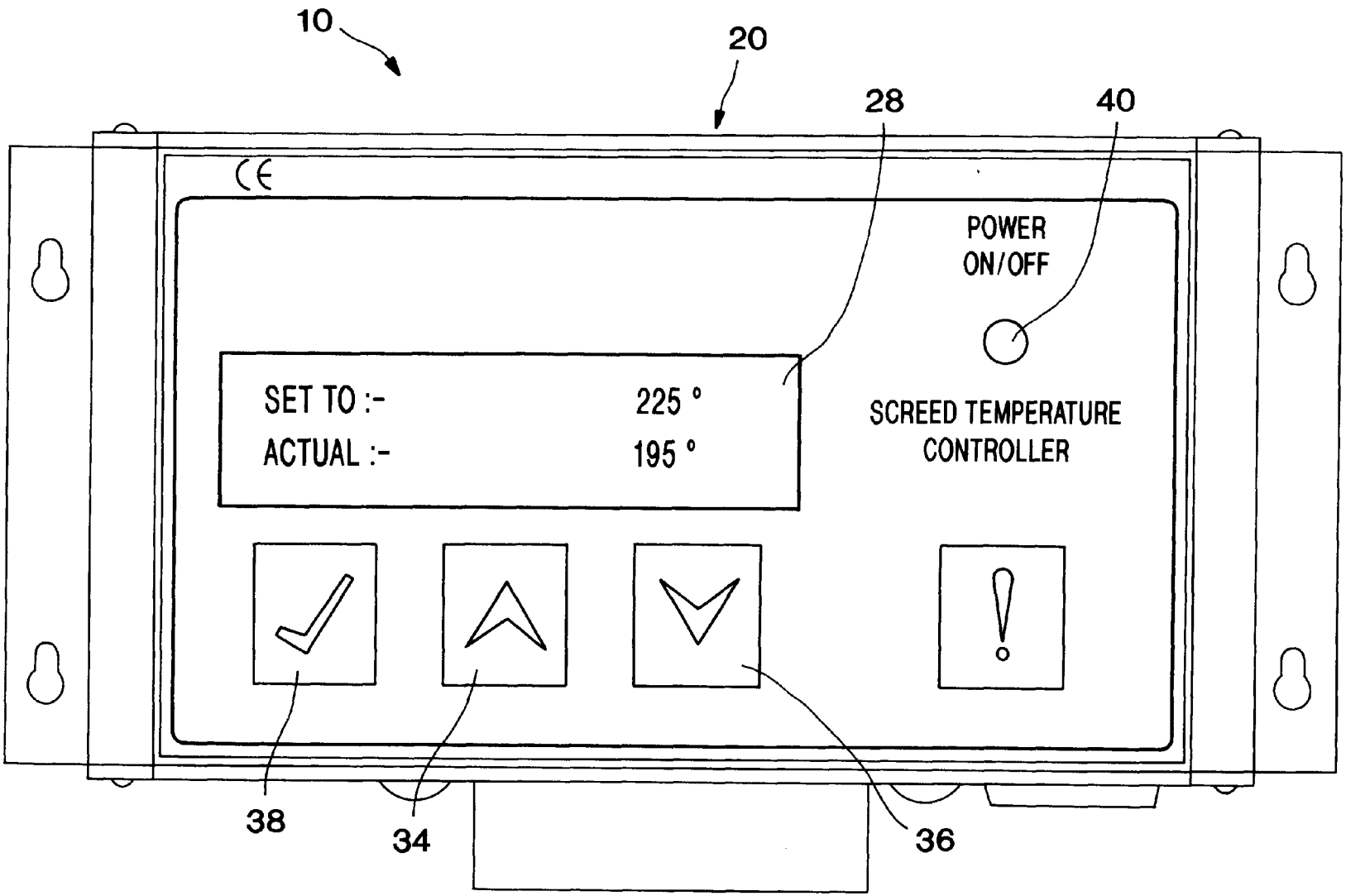
FIG. 2 is a front plan view of the controller console of the present invention.

Referring now to the drawings in detail, wherein like numbers are used to indicate like elements throughout, there is shown in FIGS. 1–2 a presently preferred control system 10 for a heating system 1 for a paving screed 2. The screed 2 includes a least one screed plate 3 used to level paving material (e.g., asphalt) and the heating system 1 is connected with the screed plate 3 and configured to transfer thermal energy to the plate 3. The heating system 1 further includes an actuator 16 configured to adjust thermal energy output of the heating system 1.

The control system 10 basically comprises a temperature sensor 12 connectable with the screed 2 and configured to sense temperature of the screed plate 3 and to generate electrical signals proportional to sensed temperature. An electrical logic circuit 14 is electrically connected with the sensor 12 and is electrically connectable with the actuator 16. The logic circuit 14 is configured to compare a temperature signal from the sensor 12 with a desired temperature value and to automatically operate the actuator 16 such that the actuator 16 adjusts thermal energy output of the heating system 1 so as to maintain screed temperature about the desired temperature value.

More specifically, the temperature sensor 12 measures the temperature of the screed plate 3 and transmits electrical signals corresponding to the measured temperature to the logic circuit 14. The electrical logic circuit 14 is connected with the sensor 12 and is configured to receive signals corresponding to the temperature measurements taken by the sensor 12. The logic circuit compares measured temperature of the screed 1 with a desired temperature or with a values of a temperature range (the "temperature band"). If the measured temperature is above a desired temperature or above a maximum temperature of the temperature range, the logic circuit 14 sends a first control signal to the actuator 16 such that the heating system 4 is either "shut off" or the thermal output of the heating system 1 is reduced. Further, the logic circuit 14 is also configured to transmit a second control signal to the actuator 16 when the measured temperature is below either a desired temperature or a minimum value in the temperature range, such that the actuator 16 either "turns on" the heating system 1 or increases the thermal output of the heating system 1. Each of the above elements is discussed in further detail below.

The temperature sensor 12 is preferably a thermocouple, and most preferably a plurality of thermocouples disposed proximal to the screed plate 3 and attached thereto. As thermocouples are well known, a detailed description is not necessary for the purposes of the present disclosure. Alternatively, the temperature sensor 12 may be any other type of device for measuring temperature that is capable of communicating or interacting with a electric logic circuit 14. It is within the scope of the present invention to utilize any appropriate device for the temperature sensor 12 that is capable of measuring the temperature of the screed plate 3 and transmitting information corresponding to the temperature to the logic circuit 14.

The logic circuit 14 is preferably a microprocessor 18 having programmable electronic memory, in other words, one or more programmable electric memory circuits. Preferably, the microprocessor 18 is a commercially available microprocessor, most preferably a model# PIC16C74 Microcontroller manufactured by Microchip Technology, Inc. of Phoenix, Ariz., USA. As microprocessors are well known, a detailed description thereof is beyond the scope of the present disclosure. Although a microprocessor 18 is preferred, the logic circuit 14 may alternatively be constructed as any other appropriate electronic logic circuit, either analog or digital, and including integrated and/or discrete circuit elements.

Preferably, the microprocessor 18 is contained within a housing 20 to which is mounted an operator interface 22, at least one input port 24 and at least one output port 26. The operator interface 22 preferably includes a display screen 28 and several input devices 30 such as buttons, switches or levers, etc., that each connect with the microprocessor 18 and enable the operator to input information into and/or program the microprocessor 18.

Further, as the controller 10 of the present invention is intended to be used with any known type of screed heating system 1, such as electrical heaters, propane heaters or diesel heaters, the actuator 16 is an appropriate type of actuator for the specific type of heating system 1 with which the particular temperature controller 10 is being used. If the heating system is an electrical resistance heating system, the actuator 16 may be one or more current actuators. For example the actuator 16 may be configured as electrical switches, such as a solid state relay or "thyristor" or electromechanical contactors, connected in circuit with the electrical power supply, such as a generator, a battery, etc. (none shown), providing power to the heating system 10. With an actuator configured as an electrical switch, electrical current is either permitted or interrupted from flowing to the electric heating elements. Another example of an appropriate type of current actuator 16 is a solenoid valves (not shown) controlling a generator used for a power supply, so as to either start/stop the generator (and thus current) or to vary generator rotational speed, and thereby vary voltage and current. Further, another appropriate configuration of a current actuator 16 is a variable resistor or a rheostat (not shown).

If the temperature controller 10 is being used with a combustible gas type of heating system (i.e., with burners and blowers), the actuator 16 may be valve (not shown) configured to regulate the flow of combustible gas or liquid to the burners, a switch used to regulate current to a blower, a switch controlling an igniter for the blower, and/or any combination of these or other appropriate devices to regulate the heating system. The temperature controller of the present invention is not limited to any specific type of heating system 1 and is intended to operate equally with any existing type of heating system 1.

Preferably, the microprocessor 18 has software stored therewithin that is programmed to enable the controller 18 to be utilized with any type of heating system as selected by the operator using one of the input devices 30. Further, the microprocessor 18 includes at least four channels enabling the controller to monitor and operate at least four separate heating devices (e.g., an electric heating pad) independently and simultaneously of the other devices. Preferably, the display screen 28 shows at least the lowest temperature of the several heating devices being monitored/operated. Further, the housing 20 preferably includes a three-colored LED (e.g., red/yellow/green) that indicates when the heating system 1 has reached a desired operating temperature, (e.g., green), whether the system 1 is still heating up (e.g., yellow), and whether their is a fault in the system 1 and the system has to shut down.

Further, the controller 10 is preferably "menu-driven" by several menus that are stored in the microprocessor 18 and sent to the display screen 28 by the microprocessor 18 so as to be viewable by the operator from the screen 28. The separate menus are selected by an operator by using one or more of the input devices 30. A default menu ("menu 0") shows the master temperature set and the lowest actual temperature (i.e., of a screed plate 3 being monitored). Other menus, e.g., "menu 1", "menu 2", etc., are used to set up the controller 10. The menus allow for activating (on/off) the heater pads or burners, selecting the type of heating system 1 to be controlled, adjusting the desired temperature, and selecting measuring system for the temperatures as either Fahrenheit or Celsius scales. Further, the menus allow for selection of the language viewed on the screen 28, such as either English, German, Spanish, etc., and other diagnostic modes to be accessed.

Once in a particular menu, particular operating parameters are selected from various options using "up" button 34 and "down" button 36 (FIG. 2) and then a particular menu is "exited" from using the menu button 38. The menus are preferably created such that when the last menu stored in the microprocessor 18 is reached by the operator, pressing the menu button 38 again will cause the microprocessor to return the default menu (0) to the display screen 28. Further, if the controller 10 is left with a menu other then the default menu displayed on the screen 28, the microprocessor will cause the default menu to again be sent to the display screen 28 after a specified period of time has elapsed.

Preferably, the controller 10 uses a standard 12V power system available on most paving screeds as the controller's source of electrical power necessary to perform all of the operations discussed above.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

Having described the invention, what is claimed:

1. A road paver screed heating system comprising:

a screed;

a screed heater connected with the screed and configured to transfer thermal energy to the screed;

a temperature sensor connected to the screed, the temperature sensor being configured to sense the temperature of the screed and generate electrical signals based on the sensed temperature; and a microprocessor electrically connected to the sensor, the microprocessor being configured to compare a temperature signal from the temperature sensor with a desired temperature value and to automatically adjust the thermal energy output of the screed heater so as to maintain the temperature of the screed near the desired temperature, the microprocessor having a stored software program that is configured to selectively configure the heating system for use with various types of screed heaters.

2. The controller as recited in claim 1 wherein the microprocessor is configured to transmit a first control signal to the actuator when sensed temperature is greater than the desired temperature value such that the actuator reduces thermal output of the heating system and to transmit a second control signal to the actuator when sensed temperature is lesser than a desired temperature value such that the actuator increases thermal output of the heating system.

3. The controller as recited in claim 1 wherein the temperature sensor is a thermocouple.

4. The controller as recited in claim 1 wherein the microprocessor is configured to compare a temperature signal from the sensor with a range of desired temperature values and to operate the actuator such that the heating system maintains screed temperature within about the range of desired temperature values.

5. The controller as recited in claim 1 wherein the microprocessor has a plurality of output channels connectable with a plurality of actuators and the microprocessor is configured to monitor and operate each of a plurality of separate heating devices independently and simultaneously.

6. The controller as recited in claim 1 further comprising operator input devices configured to enable an operator to selectively configure the microprocessor for controlling various types of heating systems.

* * * * *